US006373370B1

(12) United States Patent
Darr et al.

(10) Patent No.: US 6,373,370 B1
(45) Date of Patent: Apr. 16, 2002

(54) SPUTTERED METAL FILM FUSE STATE INDICATOR

(75) Inventors: Matthew Rain Darr, Godfrey, IL (US); Dan Rowton, Wildwood, MO (US)

(73) Assignee: Cooper Technologies, Houston, TX (US)

( * ) Notice: Subject to any disclaimer, the term of this patent is extended or adjusted under 35 U.S.C. 154(b) by 0 days.

(21) Appl. No.: 09/571,531

(22) Filed: May 16, 2000

Related U.S. Application Data

(60) Provisional application No. 60/155,845, filed on Sep. 24, 1999.

(51) Int. Cl.[7] ..... H01H 85/30

(52) U.S. Cl. ..... 337/243; 337/241; 337/206; 337/265; 116/207; 116/206; 116/200

(58) Field of Search ..... 377/243, 241, 377/242, 244, 245, 265, 266, 206; 439/490, 491, 622; 324/507, 550, 691; 340/638, 639; 361/835; 81/3.8; 116/202, 206, 207

(56) References Cited

U.S. PATENT DOCUMENTS

| | | | | | |
|---|---|---|---|---|---|
| 737,280 | A | * | 8/1903 | Sachs | 337/243 |
| 737,281 | A | * | 8/1903 | Sachs | 337/243 |
| 737,368 | A | * | 8/1903 | Downes | 337/243 |
| 737,369 | A | * | 8/1903 | Downes | 337/243 |
| 792,530 | A | * | 6/1905 | Marshall | 337/243 |
| 809,978 | A | * | 1/1906 | Ogle | 337/243 |
| 1,014,741 | A | * | 1/1912 | Barringer et al. | 337/243 |
| 1,040,150 | A | * | 10/1912 | Cole | 337/243 |
| 1,087,120 | A | * | 2/1914 | Hooker | 337/243 |
| 2,175,250 | A | * | 10/1939 | Burrows et al. | 337/243 |
| 2,737,552 | A | * | 3/1956 | Hitchcock | 337/229 |
| 4,308,516 | A | * | 12/1981 | Shimada et al. | 337/241 |
| 4,760,367 | A | * | 7/1988 | Williams | 337/241 |
| 5,122,774 | A | * | 6/1992 | Morrill, Jr. et al. | 337/246 |
| 5,776,371 | A | | 7/1998 | Parker | |
| 5,821,849 | A | | 10/1998 | Dietsch et al. | |
| 5,841,337 | A | | 11/1998 | Douglass | |
| 5,936,508 | A | | 8/1999 | Parker | |
| 5,994,993 | A | * | 11/1999 | Castonguay, Jr. et al. | 337/206 |

FOREIGN PATENT DOCUMENTS

| | | | | |
|---|---|---|---|---|
| EP | 0213404 | * | 3/1987 | 337/401 |

* cited by examiner

*Primary Examiner*—Leo P. Picard
*Assistant Examiner*—Anatoly Vortman
(74) *Attorney, Agent, or Firm*—Armstrong Teasdale LLP

(57) ABSTRACT

An opened fuse indicator includes a substantially transparent lens, a transparent base, and a dark colored backing layer. A sputtered metal layer is formed on the transparent base to provide a light-colored electrically conductive surface including a narrowed portion that forms a fuse link that is visible against the dark background of backing layer when viewed through the transparent lens. The conductive sputtered metal layer is electrically connected to a pair of fuse terminals to form a secondary fuse circuit in parallel with a main fuse circuit. Current directed through the secondary fuse circuit after the main circuit opens melts the sputtered metal layer so that it is no longer visible against the dark colored backing layer and the fuse is thereby indicated as opened.

14 Claims, 1 Drawing Sheet

SPUTTERED METAL FILM FUSE STATE INDICATOR

CROSS REFERENCE TO RELATED APPLICATIONS

This application claims the benefit of U.S. Provisional Application No. 60/155,845, filed Sep. 24, 1999.

BACKGROUND OF THE INVENTION

This invention relates generally to fuses and, more particularly, to fuses with indicators for opened fuse identification.

Fuses are widely used as overcurrent protection devices to prevent costly damage to electrical circuits. Fuse terminals typically form an electrical connection between an electrical power source and an electrical component or a combination of components arranged in an electrical circuit. A fusible link is connected between the fuse terminals, so that when electrical current flowing through the fuse exceeds a predetermined limit, the fusible link melts and opens the circuit through the fuse to prevent electrical component damage.

A large number of fuses for a given electrical system are typically contained within a fuse box, and an accompanying chart lists the particular electrical devices corresponding to the fuses contained in the box. After one or more of the fuses has opened, the chart must be reviewed to discover which particular electrical device or devices in the system are not working, and the chart must then be matched against the fuse box to locate the opened fuse or fuses. Aside from a fuse box chart, traditional fuses do not offer an adequate indicator to determine whether or not the fuse has opened. For fuse boxes that do not contain such a chart, in order to determine if a fuse has opened, or which fuse has opened, each individual fuse must be removed from the fuse box and tested or replaced, which is a monotonous, time consuming process that sometimes must be repeated before locating an opened fuse.

While some fuse indicators have been developed for use with cylindrical cartridge fuses, recent fuses have been developed which are rectangular in shape, such as a fuse described in commonly owned U.S. Pat. No. 5,841,337. Because the rectangular fuses are relatively new to the art, a fuse indicator is needed to accommodate these fuses.

Accordingly, it would be desirable to provide a less complicated and more reliable fuse indicating system that can accommodate both a cylindrical cartridge fuse and a rectangular fuse.

BRIEF SUMMARY OF THE INVENTION

In an exemplary embodiment of the invention, an opened fuse indicator includes a fuse casing having a substantially transparent lens. A transparent base is positioned adjacent the window, and a sputtered metal deposition layer on the transparent base provides a light-colored conductive surface including a narrowed portion that forms a fuse link. The conductive sputtered metal layer is electrically connected to a pair of fuse terminals to form a secondary fuse circuit in parallel with a main fuse circuit. The sputtered metal layer melts away from the fuse link portion upon the occurrence of a fault condition that causes the main fuse circuit to open, thereby directing current into the secondary fuse circuit. A dark colored backing material is disposed adjacent the clear film so that the dark material may be seen through the transparent lens after the light colored material has melted. Thus, the fuse is indicated as opened when the light colored sputtered metal layer is no longer visible.

DETAILED DESCRIPTION OF THE INVENTION

Figure 1:
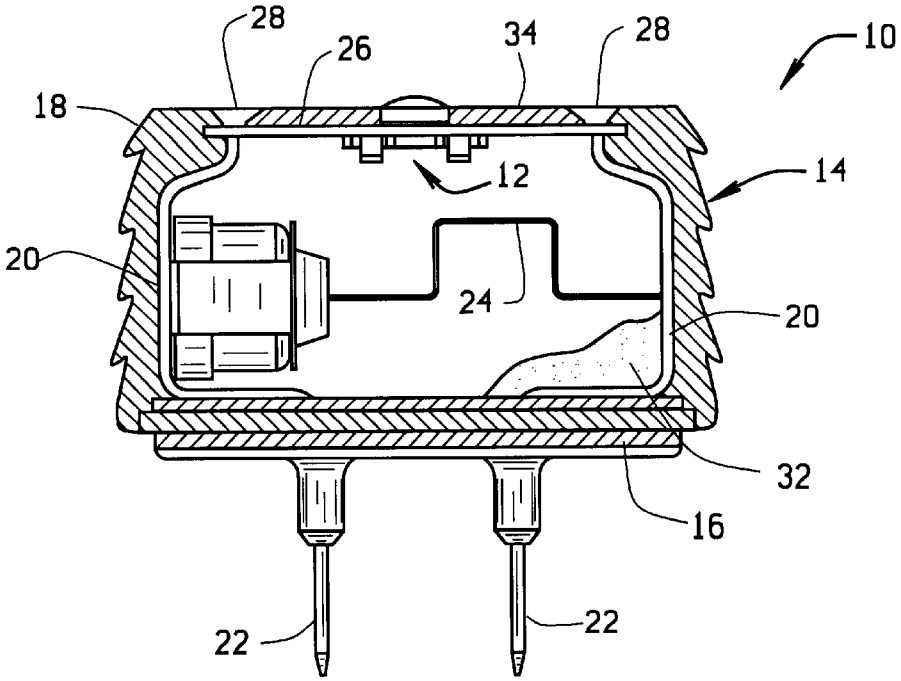
FIG. 1 is a cross sectional view of a fuse having an opened fuse indicator.

FIG. 1 is a cross sectional view of a fuse module 10 including an opened fuse indicator assembly 12. Fuse module 10 is generally rectangularly shaped and of the type described in commonly owned U.S. Pat. No. 5,841,337 (the '337 patent), which is hereby incorporated by reference. Fuse module 10 is adapted to be mounted in a respective fuse holder (not shown), details of which are included in the '337 patent. However, it should be understood that fuse indicator assembly 12 may also be used in other fuses, such as cartridge fuses, and the like.

Fuse module 10 includes a fuse casing 14 fabricated from a variety of high performance polymer materials using manufacturing processes such as injection molding. Fuse casing 14 may integrally formed, or, alternatively, constructed from multiple parts, such as a fuse module bottom 16 and a fuse module top 18, that are adhered, connected or otherwise affixed to one another. It is recognized, however, that fuse indicator assembly 12 may be used with alternative types of fuses, provided that a fuse indicating circuit can be electrically connected in parallel with a main fuse circuit.

Fuse module 10 includes a pair of fuse terminals 20 including terminal blades 22 extending from fuse module bottom 16, which fit in corresponding slots in a fuse holder (not shown). Fuse terminals 20 are connected to a main circuit fuse link 24 forming an electrical connection therebetween. Fuse terminal blades 22 are also connected to a conductive surface 26 of opened fuse indicating assembly 12 including a secondary fuse link (not shown in FIG. 1) to thereby form a parallel fuse indicating circuit between fuse terminals 20. Fuse module 10 also includes test probe contact points 28 in fuse module top 18 providing access to fuse terminals 20 for testing purposes.

Fuse module 10 is filled with heat absorbing material, such as quartz sand 32, and sealed with a fill plug (not shown in FIG. 1). Quartz sand 32 absorbs heat generated in main fuse link 24 in an overcurrent condition, which may heat main fuse link 24 to as high as 1200° C. or more. In a particular embodiment, main fuse link 24 is a thin sheet fabricated from a conductive material, such as copper, copper alloys, silver, or zinc. Alternatively, main fuse link 24 is conductive wire fabricated from copper, copper alloys, silver, or zinc.

Figure 2:
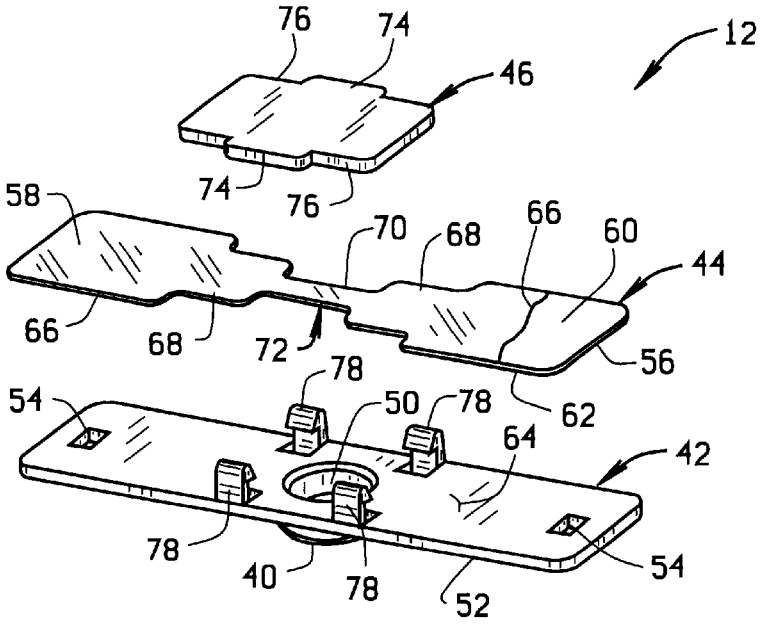
FIG. 2 is an exploded view of the fuse indicator shown in FIG. 1.

FIG. 2 is an exploded view of opened fuse indicating assembly 12 including a substantially transparent lens 40 disposed on an extension member 42, a conductive indication layer 44, and a backing layer 46. Transparent lens 40 is fabricated from a suitable transparent material known in the art, such as polycarbonate, polysulfone, or polyether sulfone. Transparent lens 40 is substantially cylindrical and extends from a top surface 52 of extension member 42, forming a cylindrical recess 50 in extension member 42. Transparent lens 40 is configured for insertion through a complementary aperture (not shown) in fuse module top 18 (shown in FIG. 1) so that transparent lens 40 is substantially flush with a top surface 34 of fuse casing 14 (as shown in FIG. 1). Extension member 42 includes rectangular apertures 54 for electrical connection of conductive layer 44 to fuse terminals 20 (shown in FIG. 1).

Conductive indicating layer 44 includes a transparent base 56, such as, for example, MYLAR film, and a layer of electrically conductive sputtered metal 58 deposited on a surface 60 of transparent base 56. An opposite surface 62 of transparent base 56 is adhered to a bottom surface 64 of extension member 42 with a suitable transparent adhesive, such as, Silicone based water soluble adhesive, that allows sputtered metal layer 58 to be seen through transparent base 56. In a particular embodiment, a sputtered metal layer deposition is applied to a top surface (not shown) of an adhesive-backed transparent sheet (not shown) of film, and a plurality of transparent bases 56 coated with the sputtered layer deposition are stamped from the sheet during fabrication of fuse indicator assembly 12. In alternative embodiments, sputtered metal layer 58 is applied to a pre-formed transparent base 56 during fabrication of fuse indicator assembly 12.

Transparent base 56 includes a first portion 66, a second portion 68, and a third portion 70 of decreasing size or cross sectional area. The sputtered metal layer 58 over transparent base third portion 70 therefore forms an electrically conductive fuse link 72 because of its relatively small cross sectional area in comparison to transparent base first and second portions 66, 68, respectively. In an alternative embodiment, transparent base 56 has a constant shape, and sputtered metal layer 58 is applied to part of transparent base 56 in a manner to create one or more segments of reduced cross sectional area of sputtered metal layer 58 to form fuse link 72.

Transparent base third portion 70 is adjacent transparent lens 40 of extension member 42 so that at least a portion of the light colored sputtered metal layer 58 is visible through transparent lens 40 and transparent base 56. In a particular embodiment, sputtered metal layer 58 is aluminum and is silver in color. In an alternative embodiment, sputtered metal layer is a copper alloy and is copper in color. In yet another alternative embodiment, sputtered metal layer is brass and is brass in color. Of course, other conductive metals and compositions of metal may be used for sputtered metal layer 58, with the color of sputtered metal layer 58 varying with the composition of metals used.

A dark colored backing layer 46 is adjacent conductive indicating layer 44 and substantially covers at least transparent base third portion 70 in the vicinity of transparent lens 40. Thus, backing layer 46 provides a contrasting color to sputtered metal layer 58 so that the status of fuse module 10 is clearly indicated from the colors seen through transparent lens 40. Backing layer 46 is substantially rectangular with opposite tabs 74 extending from longitudinal sides 76 of backing layer 46. A plurality of retaining projections 78 extending from extension member bottom surface 64 hold backing layer 46 in position relative to transparent lens 40 and transparent base 56. Longitudinal sides 76 of backing layer 46 snap-fit into retaining projections 78 with tabs 74 extending between a pair of retaining projections 78 on either longitudinal side 76 of backing layer 46. In a particular embodiment, backing layer 46 is fabricated from melamine. In alternative embodiments, backing layer is fabricated from thermoplastics, fiberboard, or other materials known in the art.

In operation, light colored sputtered metal layer 58 is disposed adjacent and extends beyond transparent lens 40 to form a secondary fuse link 72 through the secondary fuse circuit when fuse terminals 20 are electrically connected to conductive sputtered metal layer 58. A small pocket of air insulates transparent lens 40 inside cylindrical recess 50 from intense heat generated from melting of fuse link 72 in the secondary fuse circuit and prevents arc tracking by providing a volume for sputtered metal layer 58 to disperse when fuse 10 is opened. Also, sputtered metal layer 58 is light in color, such as, for example, silver, and is visible through a top of transparent lens 40 and through transparent base 56 against dark colored backing layer 46.

Hence, backing layer 46 is disposed adjacent and underneath conductive layer 44 so as to be at least partially concealed or hidden from view by sputtered metal film layer 58 when seen through a top of transparent lens 40. Backing layer 46 is of a contrasting color, such as black or another dark color, relative to sputtered metal layer 58, and is generally coextensive with transparent base third portion 70. Secondary fuse link 72 formed by sputtered metal layer 58 is electrically connected in parallel to a main fuse circuit by electrically connecting conductive sputtered metal layer 58 to fuse terminals 20.

When main circuit fuse link 24 opens, a fault current that opened main fuse link 24 flows through secondary fuse link 72 formed by sputtered metal layer 58 over transparent base third portion 70, which causes sputtered metal layer 58 to vaporize on surface 60 of at least transparent base third portion 70 and breaks an electrical connection through secondary fuse link 72. Consequently, sputtered metal layer 58 is no longer visible through transparent lens 40, and only dark colored backing layer 46 may be seen, therefore indicating that fuse module 10 has opened.

Thus, an opened fuse according to the present invention is indicated by a visible change of color from light to dark as seen through transparent lens 40. To an observer viewing the indicator transparent lens 40, when main fuse link 24 has not opened, light-colored sputtered metal layer 58 is visible through transparent lens 40. However, when main fuse link 24 is opened from a fault current, only dark-colored backing layer 46 is visible through transparent lens 40.

While the invention has been described in terms of various specific embodiments, those skilled in the art will recognize that the invention can be practiced with modification within the spirit and scope of the claims.

What is claimed is:

1. A fuse state indicator for a fuse including a main fuse circuit and a main fuse link, said fuse state indicator comprising:

a transparent lens;

a conductive indication layer adjacent said lens, said conductive indication layer forming a secondary fuse link for electrical connection in parallel with the main circuit fuse link, said secondary fuse link visible through said transparent lens; and a backing layer adjacent said conductive indication layer and at least partially concealed by said secondary fuse link when viewed through said transparent lens before the fuse has opened.

2. A fuse state indicator in accordance with claim 1 wherein said conductive indication layer comprises a transparent base and a layer of sputtered metal formed on a surface of said transparent base.

3. A fuse state indicator in accordance with claim 2 wherein said transparent base includes at least a portion of reduced cross sectional area, said sputtered metal layer formed over said portion forming said secondary fuse link.

4. A fuse state indicator in accordance with claim 1 wherein said sputtered metal layer and said backing layer have contrasting colors.

5. A fuse state indicator in accordance with claim 4 wherein said sputtered metal layer is silver.

6. A fuse for protecting electrical components in a circuit, said fuse comprising:

first and second terminals for connection to the circuit;

a main fuse link electrically connected between said first and second terminals; and a fuse indicator assembly comprising an eletrically conductive indication layer forming a secondary fuse link electrically connected between said first and second terminals, and a backing layer adjacent said conductive indication layer wherein said conductive indication layer comprises a transparent base and a layer of sputtered metal formed on a surface of said transparent base.

7. A fuse in accordance with claim 6 further comprising a transparent lens, said conductive indication layer adjacent said transparent lens, at least a portion of said conductive indication layer visible through said transparent lens before said main fuse link is opened.

8. A fuse in accordance with claim 6 wherein said transparent base includes at least a portion of reduced cross sectional area, said sputtered metal layer formed over said portion forming said secondary fuse link.

9. A fuse in accordance with claim 6 wherein said sputtered metal layer and said backing layer have contrasting colors.

10. A fuse in accordance with claim 9 wherein said sputtered metal layer is silver.

11. A method of indicating an opened fuse, said fuse including a main fuse link electrically connected between first and second terminals, and a fuse indicator assembly including a transparent lens, a transparent base, and a backing layer, said method comprising:

applying an electrically conductive layer to the transparent base, the conductive layer having a contrasting color relative to the backing material;

attaching the conductive layer adjacent the transparent lens so that at least a portion of the conductive layer is visible through the transparent lens;

attaching the backing material adjacent the conductive layer; and electrically connecting the conductive layer to the first and second terminals in parallel with the main circuit, the visible portion of the conductive layer through the transparent lens vaporizing when current flows through said conductive layer after the main fuse link has opened, thereby indicating that the fuse has opened.

12. A method in accordance with claim 11 wherein the step of applying a conductive layer comprises the steps of applying a conductive sputtered metal layer to a surface of the transparent base to form a conductive secondary fuse link of reduced cross sectional area.

13. A method in accordance with claim 12 further comprising the step of forming the transparent base to have a segment of reduced cross sectional area.

14. A method in accordance with claim 12 wherein the step of attaching the conductive layer comprises forming a gap between the transparent base and a surface of the lens to insulate the lens from heat generated when the secondary fuse link opens.

* * * * *

UNITED STATES PATENT AND TRADEMARK OFFICE

CERTIFICATE OF CORRECTION

PATENT NO. : 6,373,370 B1
DATED : April 16, 2002
INVENTOR(S) : Matthew Rain Darr et al.

It is certified that error appears in the above-identified patent and that said Letters Patent is hereby corrected as shown below:

Column 4,
Line 46, delete “a conductive” insert -- an electrically conductive --.

Signed and Sealed this

Twenty-fifth Day of November, 2003

JAMES E. ROGAN
*Director of the United States Patent and Trademark Office*